United States Patent [19]

Wilson

[11] 4,280,351

[45] Jul. 28, 1981

[54] TAPER ROLLING OF METAL

[75] Inventor: Alexander I. Wilson, Sheffield, England

[73] Assignee: Hille Engineering Company Limited, Sheffield, England

[21] Appl. No.: 42,578

[22] Filed: May 25, 1979

[30] Foreign Application Priority Data

May 26, 1978 [GB] United Kingdom ..... 23632/78

[51] Int. Cl.[3] ..... B21B 37/08; B21B 1/42

[52] U.S. Cl. ..... 72/21; 72/240

[58] Field of Search ..... 72/240, 214, 10, 21, 72/252, 8

[56] References Cited

U.S. PATENT DOCUMENTS

| | | | |
|---|---|---|---|
| 3,417,592 | 12/1968 | Fielding | 72/199 |
| 3,436,943 | 4/1969 | Freedman et al. | 72/8 |
| 3,793,868 | 2/1974 | Wilson | 72/240 X |

*Primary Examiner*—Milton S. Mehr

*Attorney, Agent, or Firm*—Brisebois & Kruger

[57] ABSTRACT

A taper-rolling machine comprises a four-high rolling mill having driven work rolls and means for adjusting one work roll and its back-up roll relative to the other work roll; a drawbar reciprocable relative to the rolling mill for drawing a blank through the mill; a mechanism for adjusting the adjustable work roll and back-up roll according to the position of the drawbar to effect taper rolling; and edger rolls acting on the blank to control the widthwise spread of the blank during rolling by the rolling mill.

10 Claims, 2 Drawing Figures

TAPER ROLLING OF METAL

This invention relates to the taper-rolling of metal and particularly, but not exclusively, to the production of tapered leaf springs.

Taper leaf springs are now used for vehicle suspensions, and, when producing such a spring by rolling, it is necessary to control the degree of taper and width very accurately, that is to say from its mid-portion towards its opposite ends.

U.S. Pat. No. 3,793,868 issued to me on Feb. 26, 1974 describes a method of taper rolling, which includes the steps of drawing a blank between a pair of work rolls and simultaneously controlling the position of one of the rolls in accordance with the linear movement of a drawbar which draws the blank between the rolls; effecting a number of phases to reduce the blank to the required form; reducing the width of the blank, before a final pass is effected by a pair of auxiliary rolls, to less than the required width so that during the final pass between the work rolls the blank returns to the required width as it is brought to the required final taper form.

In the patent the work rolls are freely rotatable, the blank being drawn through the work rolls by the tension applied to the blank by the drawbar. I have however found that it is advantageous to supplement the drawing of the blank by the drawbar by driving the rolls. In fact the main effort for moving the blank through the rolls may be provided by the roll drive; the drawing action of the drawbar is however important in maintaining the blank in tension and ensuring that its lengthwise axis is maintained substantially straight.

It has been proposed to use for taper-rolling a mill stand in which the work rolls are supported by back-up rolls in cluster configurations. It was thought that the use of small diameter work rolls, which were made possible by the support provided by the back-up rolls, would produce so little lateral spread of the blank during rolling that the width of the blank could be kept within the tolerance required. My investigation has however shown that blanks taper-rolled on such a mill are not maintained within width tolerance, unless perhaps reduction is effected in so many light passes that the overall time of working is unacceptable. In addition the rolled blanks are frequently not straight and require subsequent straightening treatment and the blanks have undesirable coarse rough edges. Lastly, the production of leaf springs on such a mill require specially shaped blanks.

An object of the present invention is to provide a taper rolling machine which will taper roll blanks in a relatively small number of passes and with edges that are substantially uniform and well formed.

In the present invention, a taper rolling machine has supported work rolls, driven either directly or through the supporting rolls, and is provided with edging rolls which ensure the rolling of blanks within width tolerance. Because they are supported, the work rolls can be relatively small in diameter, and consequently the spread of the blanks in each pass, though present, is small compared for example with the spread experienced with the machine of my British patent. The edger rolls eliminate such spread that occurs, but, as the width reduction is relatively small, the edges are given a smooth finish.

It is preferred to have each of the work rolls supported by a single back-up roll in a four-high configuration; however, each work roll may be supported by a plurality of rolls in a cluster formation.

The invention includes apparatus for the taper-rolling of a metal blank, including a pair of work rolls; at least one supporting roll for each work roll; drive means for the work rolls or the supporting rolls; a drawbar adapted to be secured to the blank and to guide the blank between the work rolls, control means for controlling the separation of the work rolls in accordance with the linear movement of the drawbar; and a pair of edger rolls for acting against the edges of the blank to reduce the lateral spread caused by the work rolls.

The invention will be more clearly understood by way of example from the following description of a method of taper rolling, and taper-rolling apparatus in accordance therewith, reference being made to the accompanying drawings, in which.

The taper rolling apparatus is generally as described in my above-mentioned patent, and operates in a similar manner. The taper rolling apparatus does, however, differ from that described in the specification in the following respects:

The Taper-Rolling Mill

Figure 1:
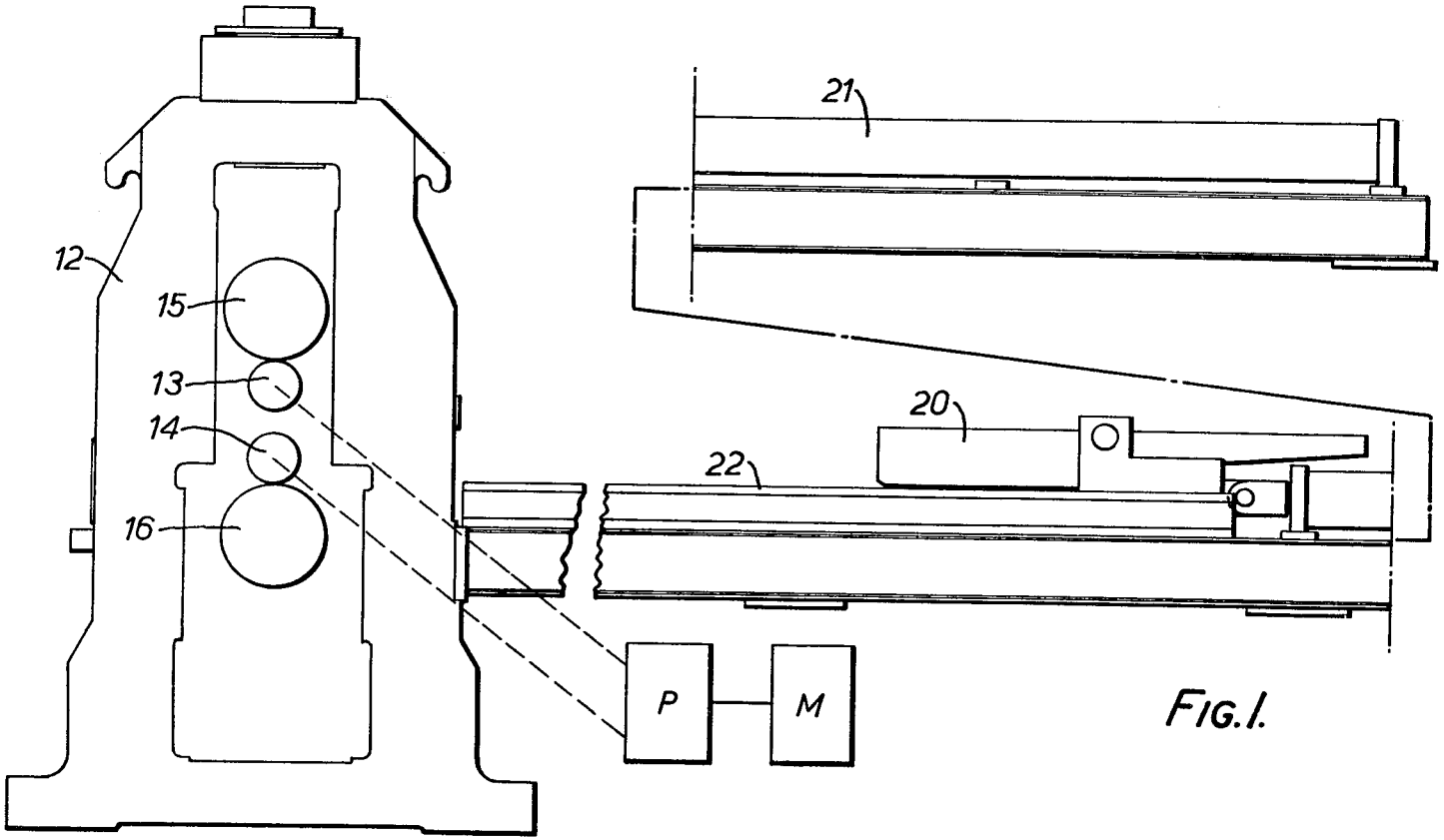
FIG. 1 is a side view of the apparatus.

As shown in FIG. 1, a four-high rolling mill is employed, having a pair of work rolls 13, 14 each supported by a back-up roll 15, 16 respectively. The work rolls 13, 14 are driven in known manner by a motor and pinion box indicated schematically at M and P respectively. The upper work roll 13 and its idler back-up roll 15 normally have fixed position, although their locations in the housings can be adjusted manually if required. The combination of the lower work roll 14 and its back-up roll 16 is, on the other hand, controlled by wedge-blocks driven by a hydraulic piston and cylinder unit, in the manner described in before-mentioned patent for the unsupported work roll of that specification.

The Control System

As in before-mentioned patent, the position of the lower work roll 14, and hence the separation of the work rolls, is automatically controlled in accordance with the position of the drawbar, which is shown at 20 in FIG. 1 and which is reciprocated by a main piston and cylinder unit 21 towards and away from the taper-rolling mill 12. Although the control system described in the above-mentioned patent specification, or other control system for the same purpose, may be employed, it is preferred to effect the control numerically, a digitizer being associated with the drawbar 20 to give a digital signal in accordance with its position along its runway 22. The digital position signal from the digitizer is applied to a circuit which gives an output representing the position of the piston of the piston and cylinder unit traversing the wedge blocks which control the vertical location of the lower work roll 14, i.e. the position of the piston of piston and cylinder unit 32 attached to wedges 72 shown in the before-mentioned patent. That piston has a position transducer, the signal from which is opposed to the output from the circuit to give an error signal, which is applied to control the piston and cylinder unit, so that the wedge is always at the position required by the location of the drawbar 20.

The Edger Rolls

Figure 2:
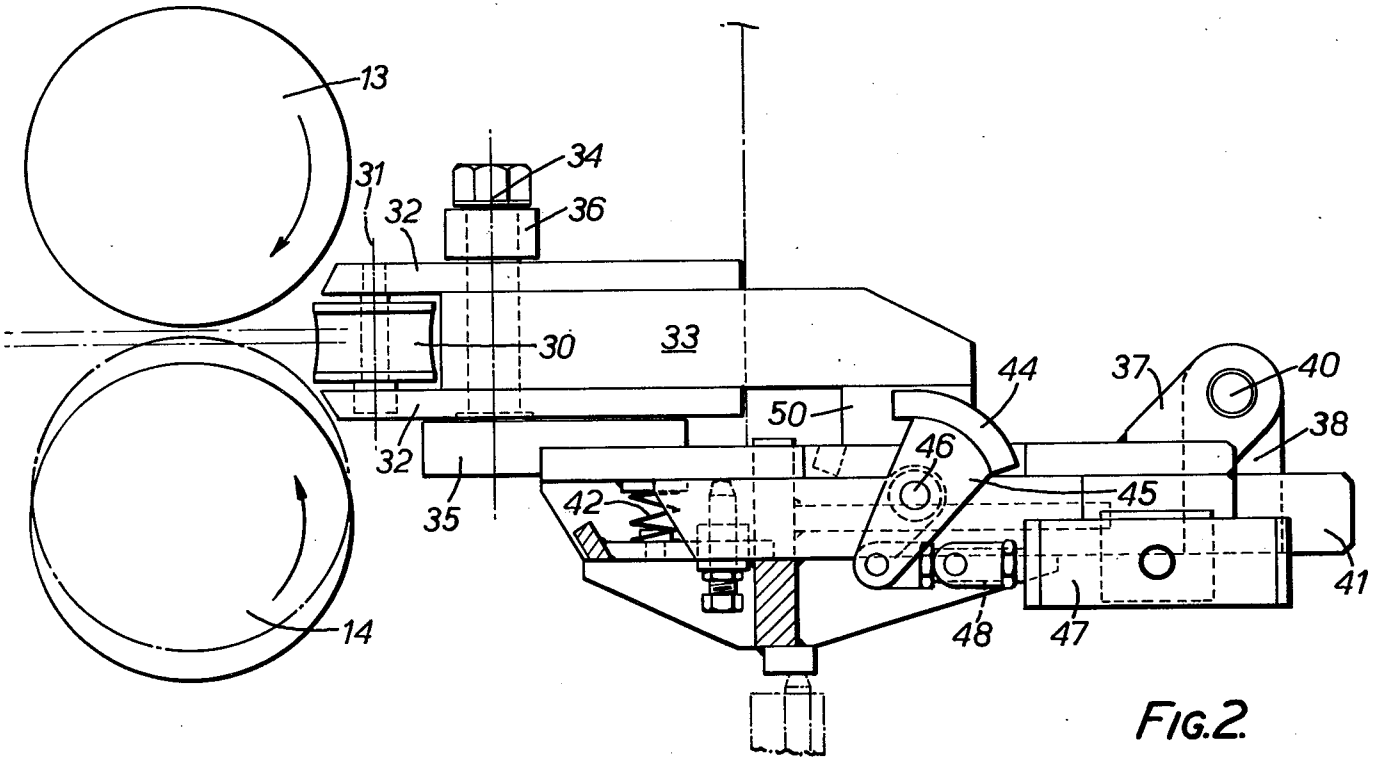
FIG. 2 is a section through one of the edger rolls.

The edger rolls, one of which is shown at 30 in FIG. 2, is generally as described and illustrated in the before-mentioned patent; in particular, the edger rolls are located adjacent the roll gap between work rolls 13, 14 on the side of the taper rolling mill 12 opposite to that of the drawbar 20. Although it may be driven if desired, each edger roll 30 is shown freely rotatable on a pin 31 carried between two arms 32 of a pivoted lever 33. Lever 33 is pivoted about a vertical pin 34 located between a sub-structure 35, which extends below the pass line and beneath the two levers, and a cross plate 36. The sub-structure 35 has two lugs 37 at its rear end; each such lug 37 is pivotally carried by an upright 38 by means of a pin 40. The two uprights 38 are secured to a base structure 41, which carries a helical compression spring 42 engaging against the underside of the sub-structure 35 and supporting the weight of the sub-structure, including the levers 33. A threaded bolt 43 limits the movement of the sub-structure 35 towards the base structure 41.

The base structure 41 further carries a rotary wedge, constituted by an arcuate wedge member 44 carried by a lever 45 which is pivoted to the base structure 41 by a horizontal pivot pin 46. A piston and cylinder unit has its cylinder 47 trunnion mounted to the base structure 42 and a piston rod end 48 pivoted to the lever 45. The wedge member 44 is located between a pair of cam follower rollers 50 carried by the ends of the two levers 33. As in the arrangement illustrated in the before-mentioned patent, counter-clockwise rotation of the lever 45 caused by operation of the piston and cylinder unit 47 results in the two levers 33 being urged apart, so that the two edge rolls 30 are driven inwardly towards the pass line. The piston and cylinder unit 47 is controlled by the digitizer on the drawbar, to cause the edge rolls 30 to be driven to the required separation for edge rolling when the drawbar starts its movement from left to right as viewed in FIG. 1. At the end of that movement, piston and cylinder unit 47 is automatically actuated to retract the edge rollers 30 away from each other.

The spring blank to be taper-rolled is heated in a furnace to rolling temperature and is attached to the clamp of the drawbar 20. The piston and cylinder unit 21 is then actuated to traverse the blank through the rolls 13, 14, the controlled machanism causing the rolls to be spaced apart during that movement and the edge rolls 30 to be separated. The first rolling pass is next performed, the blank being driven through the roll gap largely by virtue of the drive applied to the work rolls 13, 14 and partly by the drawing action of the drawbar 20; during the pass, the roll separation is progressively decreased as described. The process is then repeated for successive passes, as described in the before-mentioned patent. During each rolling pass, the edging rolls 30 are brought into their required working positions by the operation of the wedge member 44, to roll the edges of the blank and to reduce the lateral spread that has occurred during the previous rolling pass. In the final pass the lateral spread is so small that subsequent edge rolling is not required.

After the taper has been applied in that way to one end of the blank, the blank is reversed, the other end being attached to the drawbar 20 and the tapering process repeated.

As will be appreciated, the axis of the upper work roll 13 is stationary during the rolling passes, only the lower work roll 14 being adjusted during rolling. As a consequence, the median line of the blank moves upwardly in successive rolling passes. The floating support of the edging rolls 30 on the spring 42 enables the edging rolls to follow the upward trend of the median line of the blank, the concave profile of each edger roll 30 causing the following action to take place. Instead of having the edging rolls floating as described, they may be carried by the chock of roll 16 so that their vertical position is adjusted with the lower work roll.

The use of a taper rolling mill having supported work rolls enables relatively small diameter work rolls to be used with a correspondingly small lateral spread of the blank during rolling. The lateral spread that does occur in each rolling pass is reduced or eliminated by the edger rolls 30 in the successive pass, so that the overall spread can be kept within tolerance. Because the lateral spread produced by the small work rolls is relatively small, the reducing of the edges of the blank by the edger rolls is also relatively small, and the natural radius of the top and bottom of each edge can be unaffected. The desired shape of the blank edges can be further promoted by appropriate design of the profile of the edger rolls 30. In this way a flat rolled edge with rounded edges may be achieved.

What I claim is:

1. In a method of taper-rolling metal elements comprising the steps of (a) rolling a metal blank in a series of passes between a pair of work rolls;

(b) while the blank is being rolled, controlling the separation of the work rolls in accordance with the linear movement of the blank; and (c) rolling the edges of the blank with auxiliary edging rolls during at least one of the passes to reduce the lateral spread caused by the work rolls; the improvement comprising (d) supporting each of the work rolls by at least one support roll whereby said work diameter may have a relatively small diameter, and (e) driving each said work or a support roll thereof to urge said blank between said rolls in each pass.

2. A method according to claim 1, including varying together the positions of one of said work rolls and its said support roll or rolls during each pass to effect tapering.

3. A method according to claim 2, including adjusting said edging rolls to changes in the median line of said blank during rolling.

4. In apparatus for the taper-rolling of a metal blank comprising;

(a) a pair of work rolls;

(b) a drawbar for receiving said blank and guiding said blank between said work rolls;

(c) means for controlling the separation of said work rolls in accordance with the linear movement of said drawbar; and (d) a pair of edger rolls for rolling the edges of said blank in order to reduce the lateral spread of said blank caused by said work rolls; the improvement comprising including:

(e) at least one support roll for each said work roll; and (f) drive means for driving said work rolls or said support rolls.

5. Apparatus according to claim 4, in which one of the work rolls and its support roll or rolls are displaceable to vary the roll separation, and the control means include wedges arranged to adjust the positions of that work roll and its support roll or rolls.

6. Apparatus according to claim 5, in which the control means further include digital position sensors for the work roll separation and the drawbar and a digital system for deriving from the signal from the drawbar position sensor a signal representing the required position of the displaceable work roll.

7. In apparatus for the taper-rolling of a metal blank comprising (a) a pair of work rolls;

(b) a drawbar for receiving said blank and guiding said blank between said work rolls;

(c) means for controlling the separation of said work rolls in accordance with the linear movement of said drawbar; and (d) a pair of edger rolls for rolling the edges of said blank in order to reduce the lateral spread of said blank caused by said work rolls; the improvement comprising including:

(e) at least one support roll for each said work roll;

(f) drive means for driving said work rolls or said support rolls; and (g) supporting means for said edge rolls permitting said edger rolls to move in the direction of their axes, whereby said edger rolls adjust to the median line of said blank during rolling.

8. Apparatus according to claim 7, in which said supporting means comprise spring mounting for said edger rolls.

9. Apparatus according to claim 7, comprising also levers on which said edger rolls are carried, a sub-structure on which said levers are pivoted to enable the separation of said edger rolls to be varied, said sub-structure being pivotably mounted, and spring means supporting the weight of said sub-structure.

10. Apparatus according to claim 4, in which each of said edger rolls has a profile such that a required shape is given to the edges of said rolled blank.

* * * * *